US009112264B2

(12) United States Patent
Wang et al.

(10) Patent No.: US 9,112,264 B2
(45) Date of Patent: Aug. 18, 2015

(54) SWITCHED BEAM SMART ANTENNA APPARATUS AND RELATED WIRELESS COMMUNICATION CIRCUIT

(75) Inventors: Sy-been Wang, Zhubei (TW); Yu-Cheng Chen, Tainan (TW); Ching-Wei Ling, Taitung County (TW); Chih-pao Lin, Zhubei (TW)

(73) Assignee: REALTEK SEMICONDUCTOR CORP., Hsinchu (TW)

( * ) Notice: Subject to any disclaimer, the term of this patent is extended or adjusted under 35 U.S.C. 154(b) by 448 days.

(21) Appl. No.: 13/619,100

(22) Filed: Sep. 14, 2012

(65) Prior Publication Data

US 2013/0069826 A1 Mar. 21, 2013

(30) Foreign Application Priority Data

Sep. 21, 2011 (TW) ..... 100134034 A

(51) Int. Cl.

| | |
|---|---|
| ***H01Q 3/02*** | (2006.01) |
| ***H01Q 3/24*** | (2006.01) |
| ***H01Q 9/06*** | (2006.01) |
| ***H01Q 19/30*** | (2006.01) |

(52) U.S. Cl.

CPC ..... *H01Q 3/24* (2013.01); *H01Q 9/065* (2013.01); *H01Q 19/30* (2013.01)

(58) Field of Classification Search

CPC ..... H01Q 3/24; H01Q 19/30; H01Q 9/065
USPC ..... 342/374
See application file for complete search history.

(56) References Cited

U.S. PATENT DOCUMENTS

| | | | | |
|---|---|---|---|---|
| 5,025,493 | A * | 6/1991 | Cook, Jr. | 342/374 |
| 5,030,962 | A * | 7/1991 | Rees | 343/700 MS |
| 7,187,339 | B2 * | 3/2007 | Mori | 343/770 |

(Continued)

FOREIGN PATENT DOCUMENTS

| | | |
|---|---|---|
| CN | 1656646 A | 8/2005 |
| CN | 1747232 A | 3/2006 |

(Continued)

OTHER PUBLICATIONS

Zhang et al., "A Pattern Reconfigurable Microstrip Parasitic Array", IEEE Transactions on Antennas and Propagation, vol. 52, No. 10, Oct. 2004, pp. 2773-2776.

*Primary Examiner* — Frank J McGue
(74) *Attorney, Agent, or Firm* — Birch, Stewart, Kolasch & Birch, LLP

(57) ABSTRACT

A switched beam smart antenna apparatus is disclosed including: a first, a second, a third, a fourth, a fifth, a sixth, a seventh, and an eighth beam adjusting elements; a first, a second, a third, and a fourth beam control modules; a first, a second, a third, and a fourth radiation strips positioned within an area surrounded by the first to eighth beam adjusting elements; and a radiation strip control module for selecting either the first and second radiation strips or the third and fourth radiation strips to transmit signals. When the first beam control module conducts the first and second beam adjusting elements, the third beam control module does not conduct the fifth and sixth beam adjusting elements. When the second beam control module conducts the third and fourth beam adjusting elements, the fourth beam control module does not conduct the seventh and eighth beam adjusting elements.

18 Claims, 8 Drawing Sheets

(56) References Cited

U.S. PATENT DOCUMENTS

| | | | | |
|---|---|---|---|---|
| 7,388,552 | B2 | 6/2008 | Mori | |
| 2005/0162327 | A1 | 7/2005 | Mori | |
| 2007/0103377 | A1 | 5/2007 | Abramov et al. | |
| 2014/0159958 | A1 * | 6/2014 | Haziza | 342/374 |

FOREIGN PATENT DOCUMENTS

| | | | |
|---|---|---|---|
| JP | 59079871 | * | 5/1984 |
| TW | I258244 | | 7/2006 |
| TW | 200723598 | | 6/2007 |
| TW | 200933981 | | 8/2009 |

* cited by examiner

SWITCHED BEAM SMART ANTENNA APPARATUS AND RELATED WIRELESS COMMUNICATION CIRCUIT

CROSS-REFERENCE TO RELATED APPLICATIONS

This application claims the benefit of priority to Taiwanese Patent Application No. 100134034, filed on Sep. 21, 2011; the entirety of which is incorporated herein by reference for all purposes.

BACKGROUND

The present disclosure generally relates to wireless communication technology and, more particularly, to a switched beam smart antenna apparatus and related wireless communication circuit.

Antenna is an important component of a wireless communication device, but also occupies considerable area and volume of the circuit module due to the physical restriction. Nowadays, the wireless communication devices are designed to have more utilities and functions. Antennas of fixed radiation field are unable to satisfy the requirements of high end products, and thus the use of smart antenna is a trend for many wireless communication devices.

The gain of an antenna is a crucial factor for achieving better signal communication quality or further transmission range. When the antenna concentrates radiation energy toward a particular direction, signals can be transmitted further and signal quality can be improved. If the wireless communication device is allowed to flexibly adjust the transmission direction of radiation energy of the antenna during operations, the coverage of signal communication can be extended further.

However, the volume of the antenna would be greatly increased if the antenna is designed to have an adjustable radiation field. This is not complying with the market demands for thinner wireless communication devices.

SUMMARY

In view of the foregoing, it can be appreciated that a substantial need exists for apparatuses that can increase the degree of freedom of adjustment for the antenna radiation field while achieving the purpose of thinner wireless communication device.

An example embodiment of a switched beam smart antenna apparatus is disclosed comprising: a first, a second, a third, a fourth, a fifth, a sixth, a seventh, and an eighth beam adjusting elements; a first, a second, a third, and a fourth radiation strips positioned within an area surrounded by the first to the eighth beam adjusting elements; a radiation strip control module for selecting either the first and the second radiation strips or the third and the fourth radiation strips to transmit signals; a first beam control module coupled with the first and the second beam adjusting elements; a second beam control module coupled with the third and the fourth beam adjusting elements; a third beam control module coupled with the fifth and the sixth beam adjusting elements; and a fourth beam control module coupled with the seventh and the eighth beam adjusting elements; wherein when the first beam control module conducts the first and second beam adjusting elements, the third beam control module does not conduct the fifth and sixth beam adjusting elements, and when the second beam control module conducts the third and fourth beam adjusting elements, the fourth beam control module does not conduct the seventh and eighth beam adjusting elements.

Another example embodiment of a switched beam smart antenna apparatus is disclosed comprising: a plurality of beam adjusting elements; a plurality of beam control modules, each of which coupled with two of the plurality of beam adjusting elements; a plurality of radiation strips positioned within an area surrounded by the plurality of beam adjusting elements and arranged in a Y-Shape pattern, a T-Shape pattern, or an L-shape pattern; and a radiation strip control module, coupled with the plurality of radiation strips, for selecting only a portion of the plurality of radiation strips to transmit signals at a time; wherein when the radiation strip control module selects a portion of the plurality of radiation strips to transmit signals, at least one of the plurality of beam control modules conducts coupled beam adjusting elements, and the other beam control modules do not conduct coupled beam adjusting elements.

An example embodiment of a wireless communication circuit for receiving signals through a switched beam smart antenna apparatus is disclosed. The smart antenna apparatus comprises a first, a second, a third, a fourth, a fifth, a sixth, a seventh, and an eighth beam adjusting elements; a first, a second, a third, and a fourth radiation strips positioned within an area surrounded by the first to the eighth beam adjusting elements; a radiation strip control module; a first beam control module coupled with the first and the second beam adjusting elements; a second beam control module coupled with the third and the fourth beam adjusting elements; a third beam control module coupled with the fifth and the sixth beam adjusting elements; and a fourth beam control module coupled with the seventh and the eighth beam adjusting elements. The wireless communication circuit comprises: a signal processing circuit for processing signals received by the smart antenna apparatus; and a control circuit, coupled with the signal processing circuit, for controlling the radiation strip control module to select either the first and the second radiation strips or the third and the fourth radiation strips to transmit signals, and for controlling operations of the first to the fourth beam control modules; wherein when the control circuit controls the first beam control module to conduct the first and the second beam adjusting elements, the control circuit controls the third beam control module not to conduct the fifth and the sixth beam adjusting elements, and when the control circuit controls the second beam control module to conduct the third and the fourth beam adjusting elements, the control circuit controls the fourth beam control module not to conduct the seventh and the eighth beam adjusting elements.

Another example embodiment of a wireless communication circuit for receiving signals through a switched beam smart antenna apparatus is disclosed. The smart antenna apparatus comprises: a plurality of beam adjusting elements; a plurality of beam control modules; a plurality of radiation strips positioned within an area surrounded by the plurality of beam adjusting elements and arranged in a Y-Shape pattern, a T-shape pattern, or an L-shape pattern; and a radiation strip control module; wherein each of the plurality of beam control modules is coupled with two of the plurality of beam adjusting elements. The wireless communication circuit comprises: a signal processing circuit for processing signals received by the smart antenna apparatus; and a control circuit, coupled with the signal processing circuit, for controlling the radiation strip control module to select only a portion of the plurality of radiation strips to transmit signals, and for controlling operations of the plurality of beam control modules; wherein when the radiation strip control module selects a portion of the plurality of radiation strips to transmit signals, the control circuit controls at least one of the plurality of beam control modules to conduct coupled beam adjusting elements, and controls the other beam control modules not to conduct coupled beam adjusting elements.

It is to be understood that both the foregoing general description and the following detailed description are example and explanatory only and are not restrictive of the invention, as claimed.

DETAILED DESCRIPTION

Reference will now be made in detail to embodiments of the invention, which are illustrated in the accompanying drawings. The same reference numbers may be used throughout the drawings to refer to the same or like parts or components/operations.

Certain terms are used throughout the description and following claims to refer to particular components. As one skilled in the art will appreciate, a component may be referred by different names. This document does not intend to distinguish between components that differ in name but not in function. In the following description and in the claims, the term "comprise" is used in an open-ended fashion, and thus should be interpreted to mean "include, but not limited to . . . . " Also, the phrase "coupled with" is intended to compass any indirect or direct connection. Accordingly, if this document mentioned that a first device is coupled with a second device, it means that the first device may be directly or indirectly connected to the second device through electrical connections, wireless communications, optical communications, or other signal connections with/without other intermediate devices or connection means.

As used herein, the term "and/or" includes any and all combinations of one or more of the associated listed items. In addition, the singular forms "a", "an", and "the" as used herein are intended to include the plural forms as well, unless the context clearly indicates otherwise.

Throughout the description and following claims, it will be understood that when an component is referred to as being "positioned on," "positioned above," "connected to," or "engaged with" another component, it can be directly on, connected, or engaged with the other component or intervening component may be present. In contrast, when a component is referred to as being "directly on," "directly connected to," or "directly engaged with" another component, there are no intervening components present.

Figure 1:
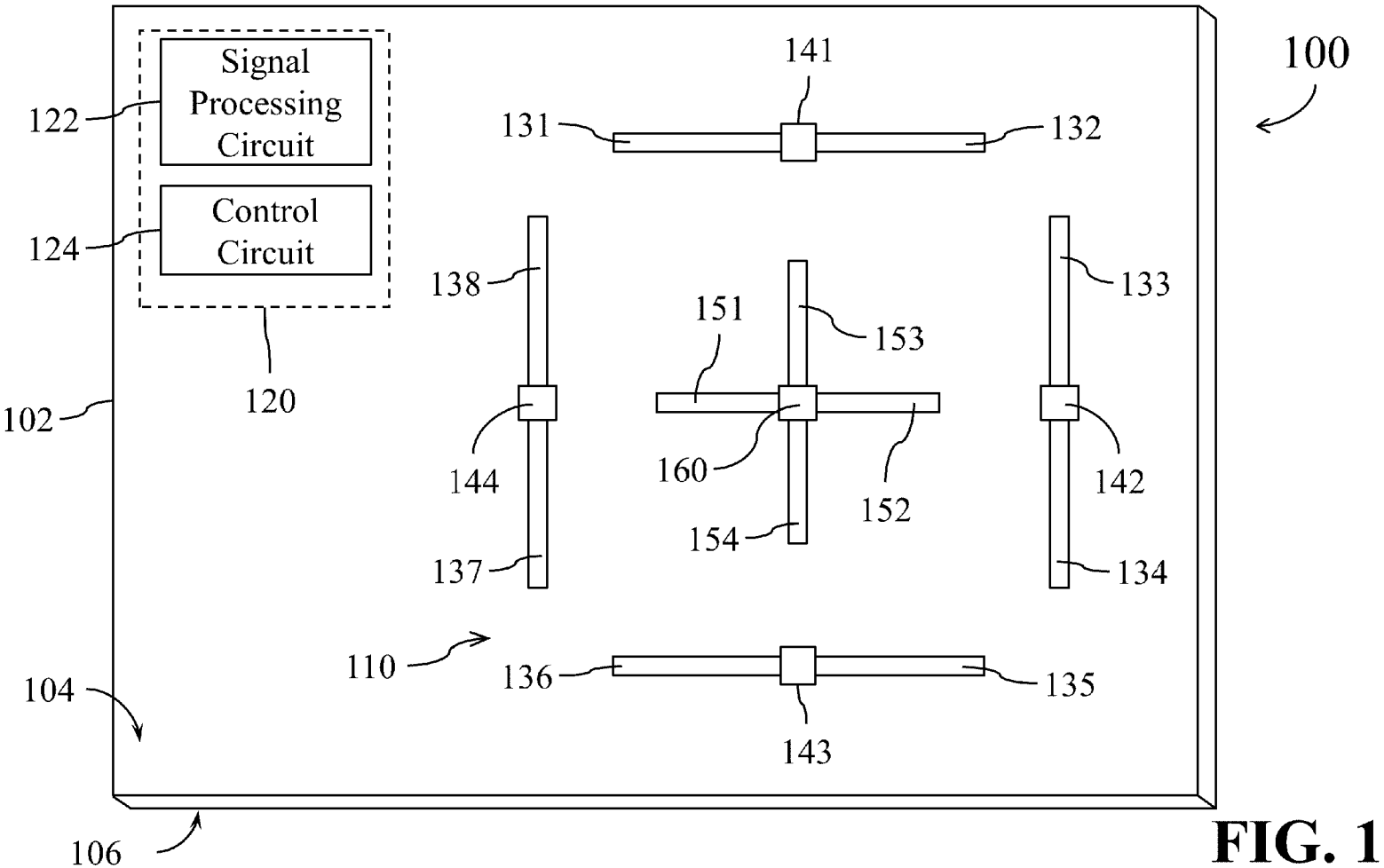
FIG. 1 is a simplified schematic diagram of a wireless communication device in accordance with an example embodiment.

Please refer to FIG. 1, which shows a simplified schematic diagram of a wireless communication device 100 in accordance with an example embodiment. The wireless communication device 100 comprises a switched beam high-gain smart antenna apparatus 110 and a wireless communication circuit 120 positioned on a substrate 102. As shown, the wireless communication circuit 120 comprises a signal processing circuit 122 and a control circuit 124. The signal processing circuit 122 is coupled with the smart antenna apparatus 110 to process signals received by the smart antenna apparatus 110. The control circuit 124 is coupled with the signal processing circuit 122 and the smart antenna apparatus 110 to control the operations of the smart antenna apparatus 110.

In this embodiment, the smart antenna apparatus 110 comprises eight beam adjusting elements 131, 132, 133, 134, 135, 136, 137, and 138, and four beam control modules 141, 142, 143, and 144. Each of the beam control modules is coupled between two beam adjusting elements to determine whether to conduct the two coupled beam adjusting elements. For example, the beam control module 141 is coupled between the beam adjusting elements 131 and 132, and the beam control module 142 is coupled between the beam adjusting elements 133 and 134, and so forth. The smart antenna apparatus 110 further comprises four radiation strips 151, 152, 153, and 154 positioned within an area surrounded by the beam adjusting elements 131~138, and a radiation strip control module 160 coupled with the radiation strips 151~154.

For the sake of brevity, other components of the wireless communication device 100 and control signals between the wireless communication circuit 120 and the smart antenna apparatus 110 are omitted in FIG. 1.

In the smart antenna apparatus 110, each of the beam adjusting elements 131, 132, 135, and 136 has an equivalent current path of a length which is greater than a length of an equivalent current path of the radiation strip 151 or the radiation strip 152, but is less than or equal to a total length of the equivalent current path of the radiation strip 151 and the equivalent current path of the radiation strip 152. A total length of the equivalent current path of the beam adjusting element 131 and the equivalent current path of the beam adjusting element 132 is greater than the total length of the equivalent current path of the radiation strip 151 and the equivalent current path of the radiation strip 152. A total length of the equivalent current path of the beam adjusting element 135 and the equivalent current path of the beam adjusting element 136 is also greater than the total length of the equivalent current path of the radiation strip 151 and the equivalent current path of the radiation strip 152. In addition, each of the beam adjusting elements 133, 134, 137, and 138 has an equivalent current path of a length which is greater than a length of an equivalent current path of the radiation strip 153 or the radiation strip 154, but is less than or equal to a total length of the equivalent current path of the radiation strip 153 and the equivalent current path of the radiation strip 154.

A total length of the equivalent current path of the beam adjusting element 133 and the equivalent current path of the beam adjusting element 134 is greater than the total length of the equivalent current path of the radiation strip 153 and the equivalent current path of the radiation strip 154. A total length of the equivalent current path of the beam adjusting element 137 and the equivalent current path of the beam adjusting element 138 is also greater than the total length of the equivalent current path of the radiation strip 153 and the equivalent current path of the radiation strip 154.

In the embodiment of FIG. 1, the radiation strips 151 and 152 are aligned to form a dipole antenna. The radiation strips 153 and 154 are aligned and perpendicular to the radiation strips 151 and 152 to form another dipole antenna. Additionally, the two beam adjusting elements coupled with each beam control module are also aligned. As shown in FIG. 1, the beam adjusting element 131, the radiation strip 151, and the beam adjusting element 136 are parallel arranged, and the radiation strip 151 is positioned between the beam adjusting element 131 and the beam adjusting element 136. A gap between the radiation strip 151 and the beam adjusting element 131 is substantially the same as a gap between the radiation strip 151 and the beam adjusting element 136. In addition, the beam adjusting element 133, the radiation strip 153, and the beam adjusting element 138 are parallel arranged, and the radiation strip 153 is positioned between the beam adjusting element 133 and the beam adjusting element 138. A gap between the radiation strip 153 and the beam adjusting element 133 is substantially the same as a gap between the radiation strip 153 and the beam adjusting element 138.

In operations, the wireless communication circuit 120 may select the dipole antenna formed by the radiation strips 151 and 152 to cooperate with the beam adjusting elements 131, 132, 135, and 136 to transmit or receive signals. Alternatively, the wireless communication circuit 120 may select the dipole antenna formed by the radiation strips 153 and 154 to cooperate with the beam adjusting elements 133, 134, 137, and 138 to transmit or receive signals. In one embodiment, the control circuit 124 of the wireless communication circuit 120 controls the radiation strip control module 160 to select either the dipole antenna formed by the radiation strips 151 and 152 or the dipole antenna formed by the radiation strips 153 and 154 to transmit or receive signals.

Figure 2:
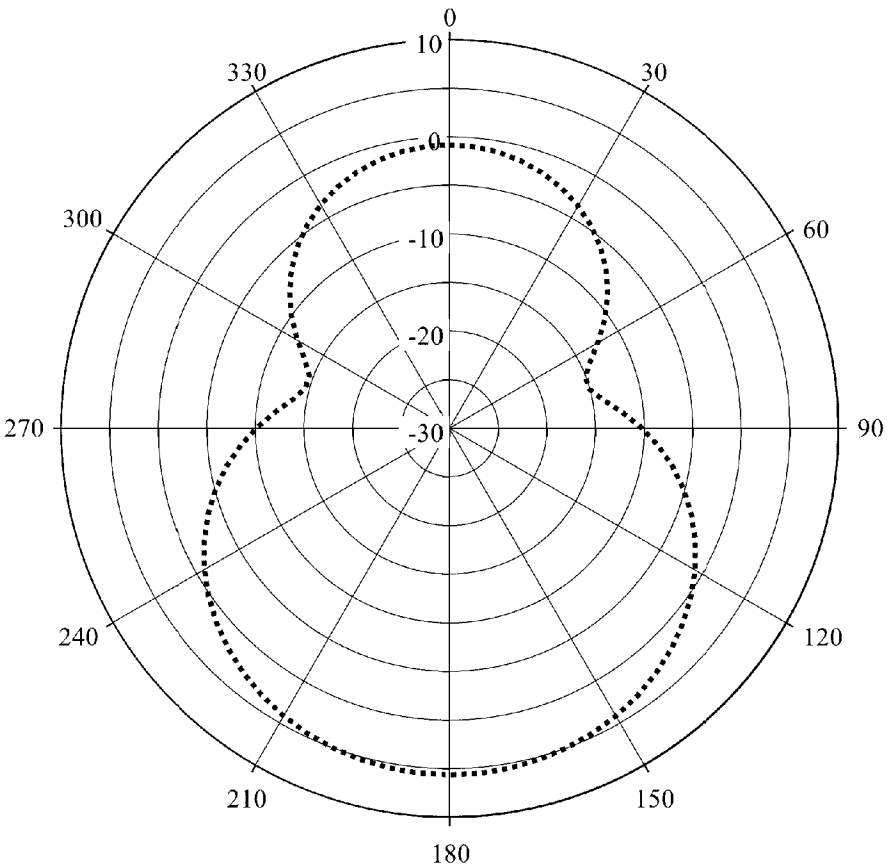
FIG. 2 through FIG. 5 are schematic diagrams of different radiation fields of the wireless communication device of FIG. 1.
Figure 3:
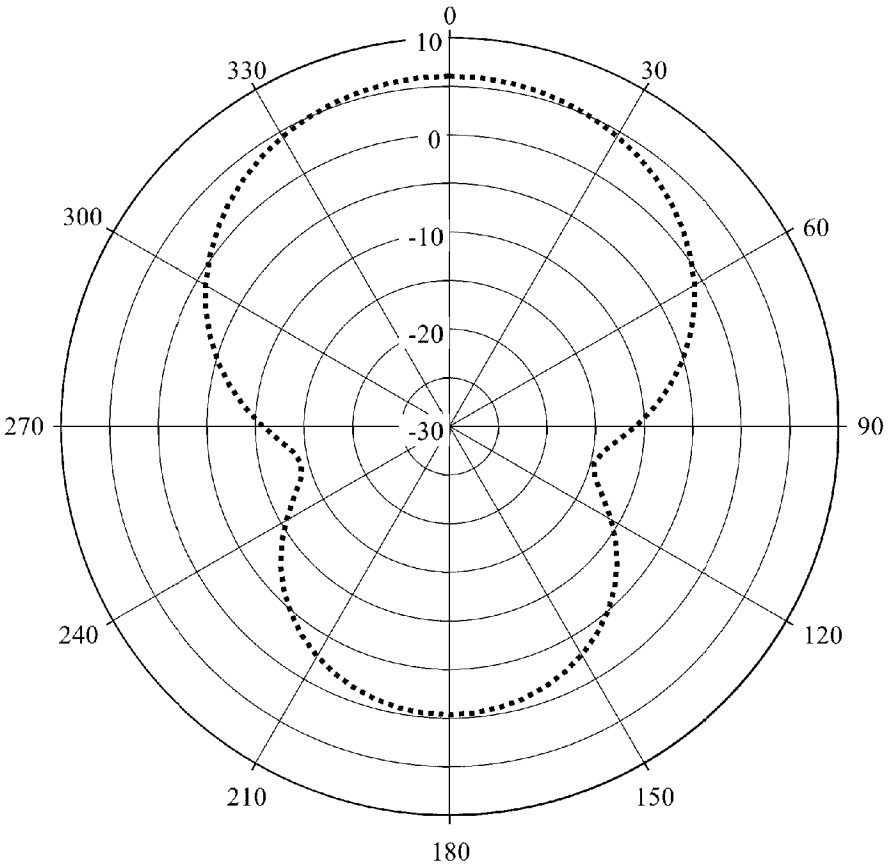

When the radiation strip control module 160 selects the dipole antenna formed by the radiation strips 151 and 152 to transmit signals, the control circuit 124 may control the switching operations of the beam control modules 141 and 143 to change the transmitting direction of the radiation energy of the dipole antenna formed by the radiation strips 151 and 152. For example, FIG. 2 is a schematic diagram of radiation field of the smart antenna apparatus 110 for the case where the control circuit 124 controls the beam control module 141 to conduct the beam adjusting elements 131 and 132, and controls the beam control module 143 not to conduct the beam adjusting elements 135 and 136. FIG. 3 is a schematic diagram of radiation field of the smart antenna apparatus 110 for the case where the control circuit 124 controls the beam control module 143 to conduct the beam adjusting elements 135 and 136, and controls the beam control module 141 not to conduct the beam adjusting elements 131 and 132.

Figure 4:
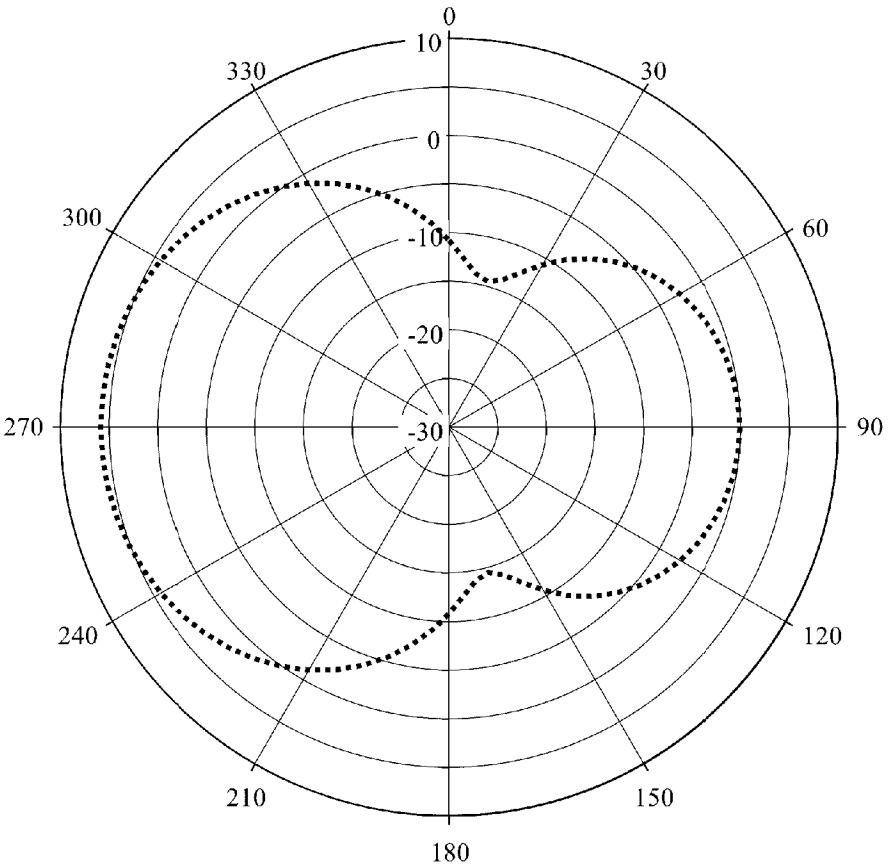
Figure 5:
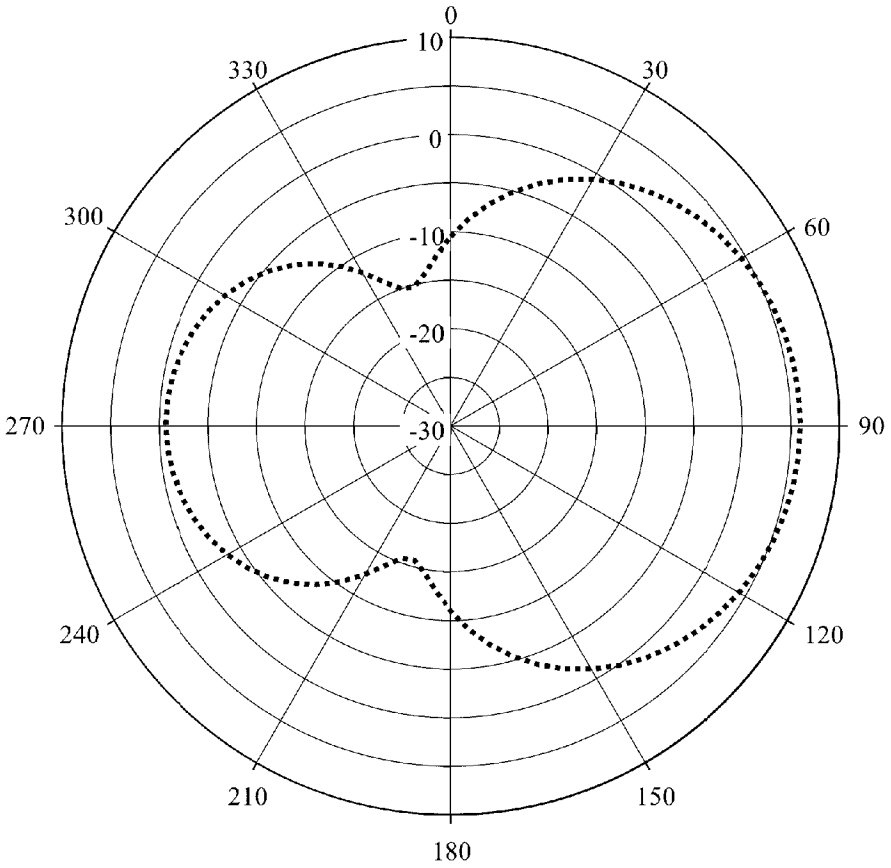

When the radiation strip control module 160 selects the dipole antenna formed by the radiation strips 153 and 154 to transmit signals, the control circuit 124 may control the switching operations of the beam control modules 142 and 144 to change the transmitting direction of the radiation energy of the dipole antenna formed by the radiation strips 153 and 154. For example, FIG. 4 is a schematic diagram of radiation field of the smart antenna apparatus 110 for the case where the control circuit 124 controls the beam control module 142 to conduct the beam adjusting elements 133 and 134, and controls the beam control module 144 not to conduct the beam adjusting elements 137 and 138. FIG. 5 is a schematic diagram of radiation field of the smart antenna apparatus 110 for the case where the control circuit 124 controls the beam control module 144 to conduct the beam adjusting elements 137 and 138, and controls the beam control module 142 not to conduct the beam adjusting elements 133 and 134.

In addition, when the beam control module 141 conducts the beam adjusting elements 131 and 132, the control circuit 124 may control the beam control module 142 not to conduct the beam adjusting elements 133 and 134, and control the beam control module 144 not to conduct the beam adjusting elements 137 and 138. Alternatively, the control circuit 124 may control the beam control module 142 to conduct the beam adjusting elements 133 and 134, and control the beam control module 144 to conduct the beam adjusting elements 137 and 138. In this two situations, the radiation fields of the smart antenna apparatus 110 may have slight difference.

As can be seen from the foregoing descriptions, the control circuit 124 may control the radiation strip control module 160 and the switching operations of the beam control modules 141~144 to change the radiation field and transmitting direction of radiation energy of the smart antenna apparatus 110. As a result, the signal coverage of the smart antenna apparatus 110 can be extended by using the previous approaches to switch the radiation beams of the smart antenna apparatus 110, thereby increasing the communication range of the wireless communication device 100. Additionally, the wireless communication device 100 may adopt the previous approaches to select a best signal channel in a multipath reflective area to greatly improve the signal communication quality.

Figure 6:
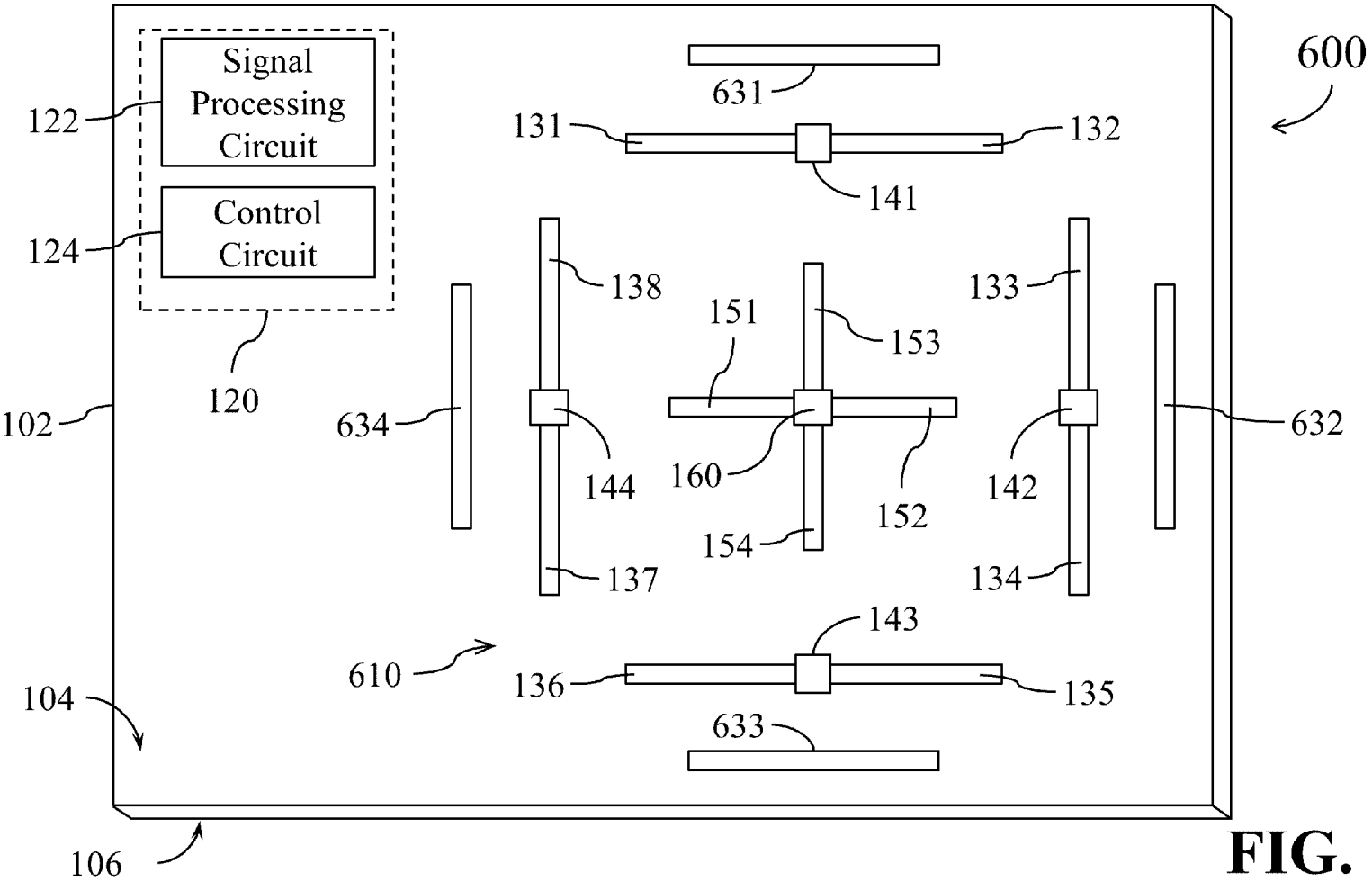
FIG. 6 through FIG. 8 are simplified schematic diagrams of wireless communication devices in accordance with other example embodiments.

Please refer to FIG. 6, which shows a simplified schematic diagram of a wireless communication device 600 in accordance with another example embodiment. A switched beam high-gain smart antenna apparatus 610 of the wireless communication device 600 has a similar structure as the previous smart antenna apparatus 110. Accordingly, the description regarding the operations and implementations for the components of the smart antenna apparatus 110 is also applicable to the embodiment of FIG. 6. Compared to the smart antenna apparatus 110, the smart antenna apparatus 610 further comprises four outer beam adjusting elements 631, 632, 633, and 634.

Each of the outer beam adjusting elements 631 and 633 has an equivalent current path of a length less than or equal to a total length of an equivalent current path of the radiation strip 151 and an equivalent current path of the radiation strip 152. In addition, each of the outer beam adjusting elements 632 and 634 has an equivalent current path of a length less than or equal to a total length of an equivalent current path of the radiation strip 153 and an equivalent current path of the radiation strip 154.

In the embodiment of FIG. 6, the outer beam adjusting element 631, the radiation strip 151, and the outer beam adjusting element 633 are parallel arranged, and a gap between the radiation strip 151 and the outer beam adjusting element 631 is substantially the same as a gap between the radiation strip 151 and the outer beam adjusting element 633. Additionally, the outer beam adjusting element 632, the radiation strip 153, and the outer beam adjusting element 634 are parallel arranged, and a gap between the radiation strip 153 and the outer beam adjusting element 632 is substantially the same as a gap between the radiation strip 153 and the outer beam adjusting element 634.

When the radiation strip control module 160 selects the dipole antenna formed by the radiation strips 151 and 152 to transmit signals, the presence of the outer beam adjusting element 631 or 633 would further concentrate the radiation energy of the dipole antenna formed by the radiation strips 151 and 152. For example, when the beam control module 141 conducts the beam adjusting elements 131 and 132, but the beam control module 143 does not conduct the beam adjusting elements 135 and 136, since the length of equivalent current path of each of the beam adjusting element 135, the beam adjusting element 136, and the outer beam adjusting element 633 is less than or equal to the total length of the equivalent current path of the radiation strip 151 and the equivalent current path of the radiation strip 152, the radiation energy of the dipole antenna formed by the radiation strips 151 and 152 would further concentrate toward the direction of the outer beam adjusting element 633.

Similarly, when the radiation strip control module 160 selects the dipole antenna formed by the radiation strips 153 and 154 to transmit signals, the presence of the outer beam adjusting element 632 or 634 would further concentrate the radiation energy of the dipole antenna formed by the radiation strips 153 and 154. For example, when the beam control module 142 conducts the beam adjusting elements 133 and 134, but the beam control module 144 does not conduct the beam adjusting elements 137 and 138, since the length of equivalent current path of each of the beam adjusting element 137, the beam adjusting element 138, and the outer beam adjusting element 634 is less than or equal to the total length of the equivalent current path of the radiation strip 153 and the equivalent current path of the radiation strip 154, the radiation energy of the dipole antenna formed by the radiation strips 153 and 154 would further concentrate toward the direction of the outer beam adjusting element 634.

With the outer beam adjusting elements 631, 632, 633, and 634, the control circuit 124 is capable of further concentrating the radiation energy of the smart antenna apparatus 610. As a result, the signal coverage of the smart antenna apparatus 610 can be extended, thereby increasing the transmission range of the wireless communication device 600 and improving the signal communication quality.

Figure 7:
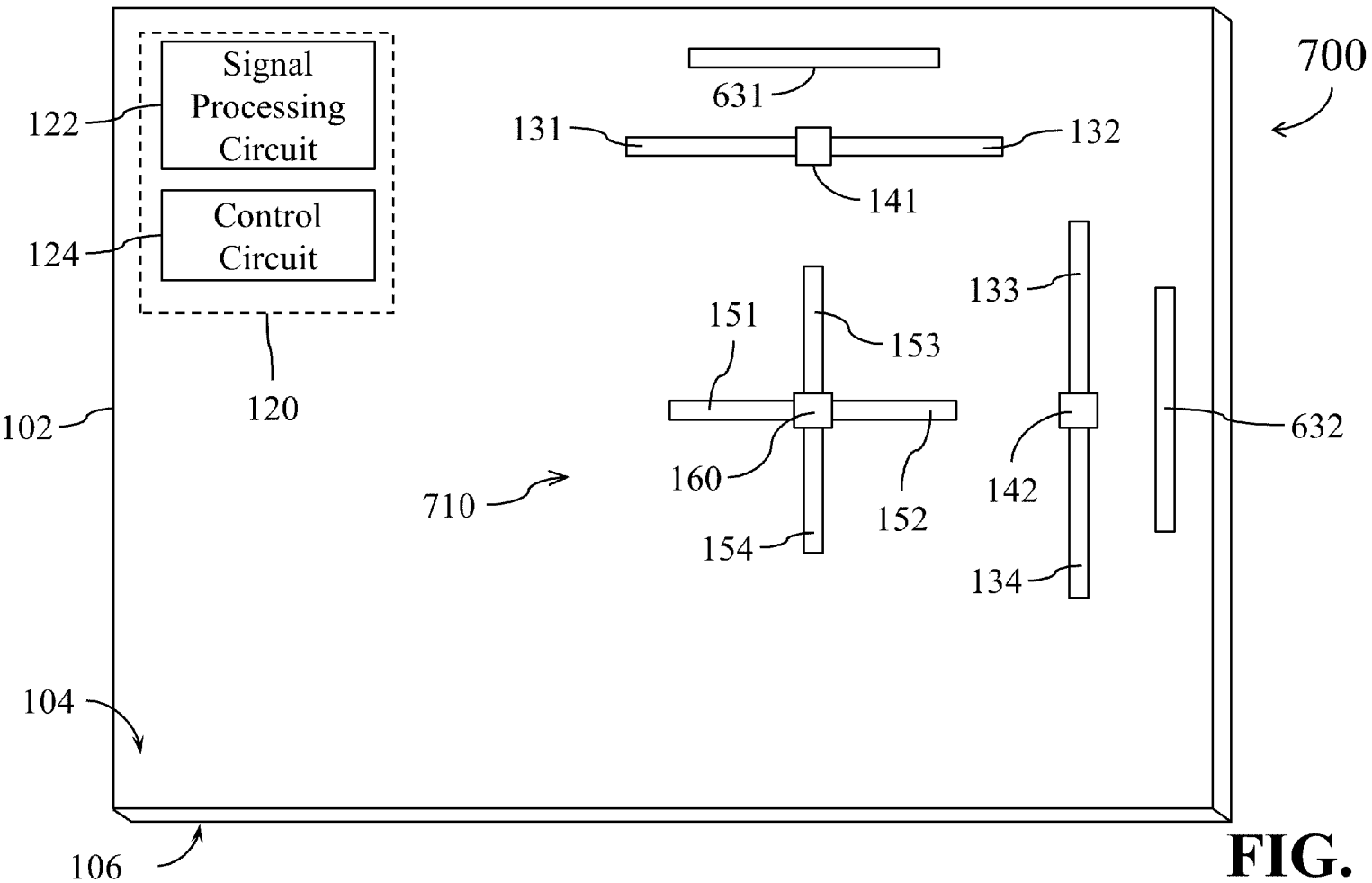

In implementations, the number and positions of the radiation strips, the beam adjusting elements, and the beam control modules of the smart antenna apparatus are not restricted by the previous embodiments. For example, in an embodiment shown in FIG. 7, some components of the smart antenna apparatus 610 are omitted in a smart antenna apparatus 710 of a wireless communication device 700.

Figure 8:
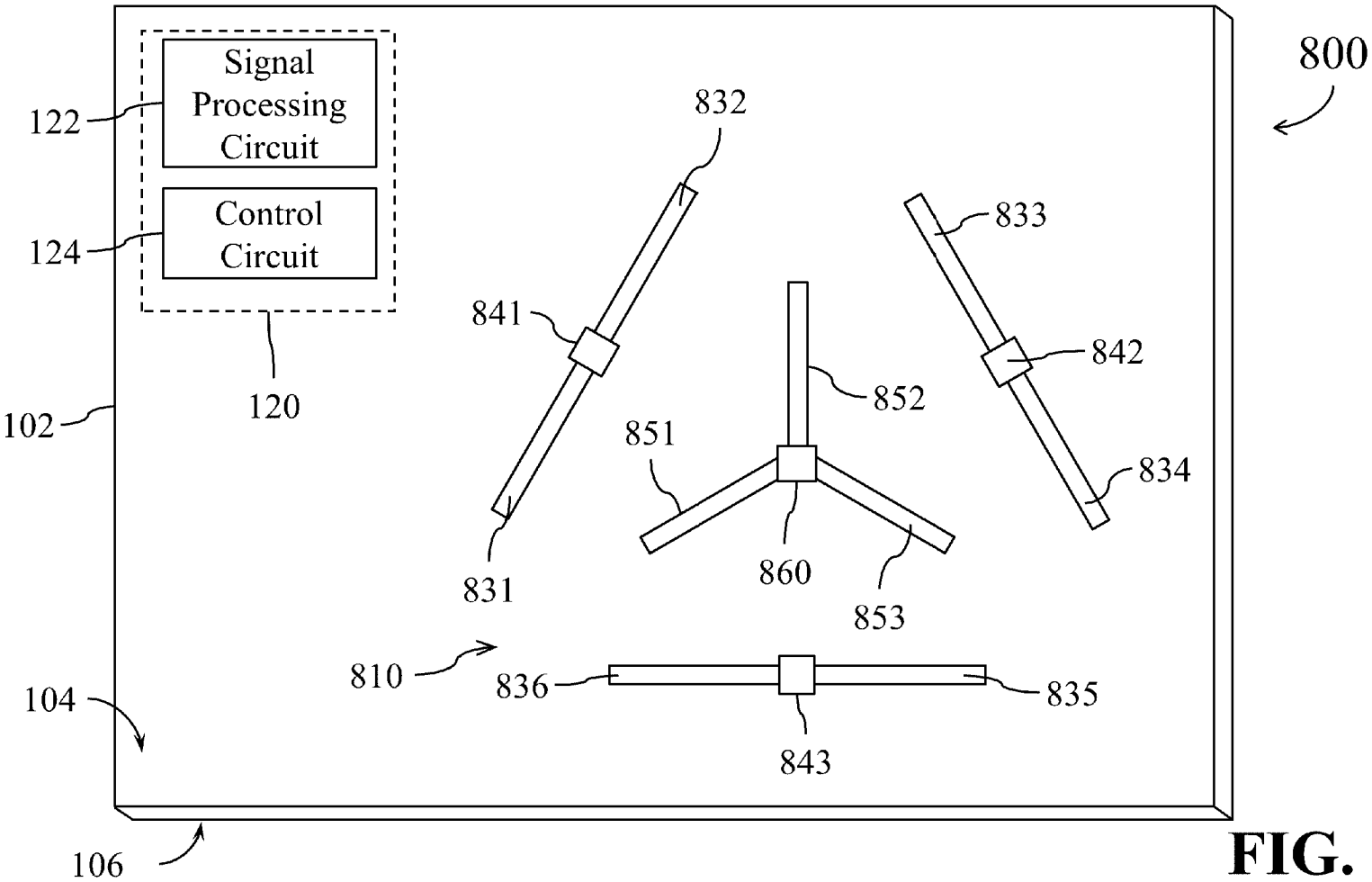

In some embodiments, the radiation strips of the smart antenna apparatus may be arranged in a Y-Shape pattern, a T-Shape pattern, or an L-shape pattern depending upon the circuitry design requirements. For example, in a wireless communication device 800 shown in FIG. 8, a smart antenna apparatus 810 comprises six beam adjusting elements 831, 832, 833, 834, 835, and 836 arranged in the form of a triangle; three radiation strips 851, 852, and 853 positioned within an area defined by the beam adjusting elements 831836 and arranged in a Y-Shape pattern; three beam control modules 841, 842, and 843; and a radiation strip control module 860. In the wireless communication device 800, the control circuit 124 controls the radiation strip control module 860 to select only a portion of the radiation strips 851~853 to transmit signals at a time. Simultaneously, the control circuit 124 controls at least one beam control module of the beam control modules 841~843 to conduct coupled beam adjusting elements, but controls the other beam control modules not to conduct coupled beam adjusting elements.

Each of the radiation strips and the beam adjusting elements in the previous embodiments may be a flat metal strip or a printed strip formed on the substrate 102. In some embodiments, each of the radiation strips and the beam adjusting elements in the previous embodiments may be realized by printed strips. In addition, each of the radiation strips and beam adjusting elements may be formed in a straight pattern, an L-shape pattern, or an h-shape pattern. In implementations, all radiation strips and beam adjusting elements of each of the previous smart antenna apparatus may be positioned on the same plane of the substrate 102, such as a plane 104. Alternatively, it is allowed to position some of the radiation strips and beam adjusting elements on a particular plane, such as the plane 104, of the substrate 102, while positioning the other radiation strips and beam adjusting elements on another plane, such as a plane 106, of the substrate 102, to increase the layout flexibility of the antenna apparatus. In addition, each of the previous beam control modules and radiation strip control modules may be a switching circuit realized by diodes, transistors, or micro electro mechanical systems (MEMS).

The disclosed switched beam smart antenna apparatus may be applied in various wireless communication devices, such as a wireless network card, a wireless access point (AP), and any other home appliance capable of supporting wireless communication operations, such as a TV or a DVD player. In addition, since the radiation strips and beam adjusting elements of the disclosed smart antenna apparatus can be implemented with a flat structure, the entire antenna apparatus can be realized in a very thin structure, and thus the disclosed antenna apparatus is very suitable to be applied in any wireless communication device with a thin profile, such as a notebook computer, a tablet PC, an e-book, and the like.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A switched beam smart antenna apparatus, comprising:

a first, a second, a third, a fourth, a fifth, a sixth, a seventh, and an eighth beam adjusting elements;

a first, a second, a third, and a fourth radiation strips positioned within an area surrounded by the first to the eighth beam adjusting elements;

a radiation strip control module for selecting either the first and the second radiation strips or the third and the fourth radiation strips to transmit signals;

a first beam control module coupled with the first and the second beam adjusting elements;

a second beam control module coupled with the third and the fourth beam adjusting elements;

a third beam control module coupled with the fifth and the sixth beam adjusting elements; and a fourth beam control module coupled with the seventh and the eighth beam adjusting elements;

wherein when the first beam control module conducts the first and second beam adjusting elements, the third beam control module does not conduct the fifth and sixth beam adjusting elements, and when the second beam control module conducts the third and fourth beam adjusting elements, the fourth beam control module does not conduct the seventh and eighth beam adjusting elements;

wherein the first beam adjusting element has an equivalent current path of a length less than or equal to a total length of an equivalent current path of the first radiation strip and an equivalent current path of the second radiation strip, but a total length of an equivalent current path of the first beam adjusting element and an equivalent current path of the second beam adjusting element is greater than the total length of the equivalent current path of the first radiation strip and the equivalent current path of the second radiation strip.

2. The switched beam smart antenna apparatus of claim 1, wherein the first beam control module conducts the first and second beam adjusting elements, the second beam control module conducts the third and fourth beam adjusting elements.

3. The switched beam smart antenna apparatus of claim 1, wherein the equivalent current path of the first beam adjusting element has a length greater than a length of the equivalent current path of the first radiation strip.

4. The switched beam smart antenna apparatus of claim 3, wherein the first radiation strip is positioned between the first beam adjusting element and the sixth beam adjusting element, the third radiation strip is positioned between the third beam adjusting element and the eighth beam adjusting element, and a gap between the first radiation strip and the first beam adjusting element is substantially the same as a gap between the first radiation strip and the sixth beam adjusting element.

5. The switched beam smart antenna apparatus of claim 4, wherein the first radiation strip is perpendicular to the third radiation strip and is also perpendicular to the fourth radiation strip.

6. The switched beam smart antenna apparatus of claim 5, wherein a portion of the first to the eighth beam adjusting elements is positioned on a plane of a circuit board, and another portion of the first to the eighth beam adjusting elements is positioned on another plane of the circuit board.

7. The switched beam smart antenna apparatus of claim 6, wherein at least one of the first to the fourth radiation strips is positioned on a plane of the circuit board, and another portion of the first to the fourth radiation strips is positioned on another plane of the circuit board.

8. The switched beam smart antenna apparatus of claim 3, further comprising:

a first, a second, a third, and a fourth outer beam adjusting elements positioned in a periphery of the first to the eighth beam adjusting elements;

wherein each of the first outer beam adjusting element and the third outer beam adjusting element has an equivalent current path of a length less than the total length of the equivalent current path of the first radiation strip and the equivalent current path of the second radiation strip, and each of the second outer beam adjusting element and the fourth outer beam adjusting element has an equivalent current path of a length less than a total length of an equivalent current path of the third radiation strip and an equivalent current path of the fourth radiation strip.

9. The switched beam smart antenna apparatus of claim 8, wherein each of the first to the fourth outer beam adjusting elements is a metal strip.

10. The switched beam smart antenna apparatus of claim 1, wherein each of the first to the eighth beam adjusting elements is a metal strip.

11. The switched beam smart antenna apparatus of claim 10, wherein at least one of the radiation strips and beam adjusting elements is formed in an L-shape pattern or an h-shape pattern.

12. A switched beam smart antenna apparatus, comprising:

a plurality of beam adjusting elements, comprising a first beam adjusting element;

a plurality of beam control modules, each of which coupled with two of the plurality of beam adjusting elements;

a plurality of radiation strips positioned within an area surrounded by the plurality of beam adjusting elements and arranged in a Y-shape pattern, a T-shape pattern, or an L-shape pattern, wherein the plurality of radiation strips comprise a first radiation strip and a second radiation strip; and a radiation strip control module, coupled with the plurality of radiation strips, for selecting only a portion of the plurality of radiation strips to transmit signals at a time;

wherein when the radiation strip control module selects a portion of the plurality of radiation strips to transmit signals, at least one of the plurality of beam control modules conducts coupled beam adjusting elements, and the other beam control modules do not conduct coupled beam adjusting elements;

wherein the first beam adjusting element has an equivalent current path of a length less than or equal to a total length of an equivalent current path of the first radiation strip and an equivalent current path of the second radiation strip, but a total length of the equivalent current path of the first beam adjusting element and an equivalent current path of a nearby beam adjusting element is greater than the total length of the equivalent current path of the first radiation strip and the equivalent current path of the second radiation strip.

13. The switched beam smart antenna apparatus of claim 12, wherein the equivalent current path of the first beam adjusting element has a length greater than a length of the equivalent current path of the first radiation strip.

14. The switched beam smart antenna apparatus of claim 13, further comprising:

a plurality of fourth outer beam adjusting elements positioned in a periphery of the plurality of beam adjusting elements;

wherein a first outer beam adjusting element of the plurality of outer beam adjusting elements has an equivalent current path of a length less than the total length of the equivalent current path of the first radiation strip and the equivalent current path of the second radiation strip.

15. The switched beam smart antenna apparatus of claim 12, wherein each of the plurality of beam adjusting elements is a metal strip.

16. The switched beam smart antenna apparatus of claim 15, wherein at least one of the radiation strips and beam adjusting elements is formed in an L-shape pattern or an h-shape pattern.

17. A wireless communication circuit for receiving signals through a switched beam smart antenna apparatus, the smart antenna apparatus comprising a first, a second, a third, a fourth, a fifth, a sixth, a seventh, and an eighth beam adjusting elements; a first, a second, a third, and a fourth radiation strips positioned within an area surrounded by the first to the eighth beam adjusting elements; a radiation strip control module; a first beam control module coupled with the first and the second beam adjusting elements; a second beam control module coupled with the third and the fourth beam adjusting elements; a third beam control module coupled with the fifth and the sixth beam adjusting elements; and a fourth beam control module coupled with the seventh and the eighth beam adjusting elements; the wireless communication circuit comprising:

a signal processing circuit for processing signals received by the smart antenna apparatus; and a control circuit, coupled with the signal processing circuit, for controlling the radiation strip control module to select either the first and the second radiation strips or the third and the fourth radiation strips to transmit signals, and for controlling operations of the first to the fourth beam control modules;

wherein when the control circuit controls the first beam control module to conduct the first and the second beam adjusting elements, the control circuit controls the third beam control module not to conduct the fifth and the sixth beam adjusting elements, and when the control circuit controls the second beam control module to conduct the third and the fourth beam adjusting elements, the control circuit controls the fourth beam control module not to conduct the seventh and the eighth beam adjusting elements;

wherein the first beam adjusting element has an equivalent current path of a length less than or equal to a total length of an equivalent current path of the first radiation strip and an equivalent current path of the second radiation strip, but a total length of an equivalent current path of the first beam adjusting element and an equivalent current path of the second beam adjusting element is greater than the total length of the equivalent current path of the first radiation strip and the equivalent current path of the second radiation strip.

18. A wireless communication circuit for receiving signals through a switched beam smart antenna apparatus, the smart antenna apparatus comprising: a plurality of beam adjusting elements comprising a first beam adjusting element; a plurality of beam control modules; a plurality of radiation strips positioned within an area surrounded by the plurality of beam adjusting elements and arranged in a Y-shape pattern, a T-shape pattern, or an L-shape pattern; and a radiation strip control module; wherein the plurality of radiation strips comprise a first radiation strip and a second radiation strip, and each of the plurality of beam control modules is coupled with two of the plurality of beam adjusting elements; the wireless communication circuit comprising:

a signal processing circuit for processing signals received by the smart antenna apparatus; and a control circuit, coupled with the signal processing circuit, for controlling the radiation strip control module to select only a portion of the plurality of radiation strips to transmit signals, and for controlling operations of the plurality of beam control modules;

wherein when the radiation strip control module selects a portion of the plurality of radiation strips to transmit signals, the control circuit controls at least one of the plurality of beam control modules to conduct coupled beam adjusting elements, and controls the other beam control modules not to conduct coupled beam adjusting elements;

wherein the first beam adjusting element has an equivalent current path of a length less than or equal to a total length of an equivalent current path of the first radiation strip and an equivalent current path of the second radiation strip, but a total length of the equivalent current path of the first beam adjusting element and an equivalent current path of a nearby beam adjusting element is greater than the total length of the equivalent current path of the first radiation strip and the equivalent current path of the second radiation strip.

* * * * *